US006349766B1

(12) United States Patent
Bussear et al.

(10) Patent No.: US 6,349,766 B1
(45) Date of Patent: Feb. 26, 2002

(54) CHEMICAL ACTUATION OF DOWNHOLE TOOLS

(75) Inventors: Terry R. Bussear, Friendswood, TX (US); Sebastiaan J. Wolters, Sultanate of Oman (NL)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/305,695

(22) Filed: May 5, 1999

Related U.S. Application Data

(60) Provisional application No. 60/084,232, filed on May 5, 1998.

(51) Int. Cl.[7] ..... E21B 43/00; E21B 43/22; E21B 47/00

(52) U.S. Cl. ..... 166/113; 166/250.15

(58) Field of Search ..... 166/113, 250.15

(56) References Cited

U.S. PATENT DOCUMENTS

| | | | | |
|---|---|---|---|---|
| 2,658,724 | A | 11/1953 | Arps | 175/41 |
| 3,010,515 | A | 11/1961 | Harrison et al. | 166/54.5 |
| 3,018,828 | A | 1/1962 | Prentiss | 166/53 |
| 4,611,664 | A | 9/1986 | Osterhoudt, III et al. | 166/305.1 |
| 4,770,243 | A | 9/1988 | Fouillout et al. | 166/53 |
| 4,805,450 | A | 2/1989 | Bennett et al. | 73/152.29 |
| 5,047,632 | A | 9/1991 | Hunt | 250/302 |
| 5,265,680 | A | 11/1993 | Withers et al. | 166/380 |
| 5,273,113 | A | 12/1993 | Schultz | 166/374 |
| 5,343,963 | A | 9/1994 | Bouldin et al. | 175/27 |
| 5,635,712 | A | 6/1997 | Scott, III et al. | 250/260 |
| 5,662,165 | A | 9/1997 | Tubel et al. | 166/250.01 |
| 5,709,269 | A | 1/1998 | Head | 166/376 |

FOREIGN PATENT DOCUMENTS

| | | |
|---|---|---|
| GB | 2 123 062 | 6/1983 |
| GB | 2 309 471 | 1/1997 |
| WO | WO 97/49894 | 6/1997 |
| WO | WO 98/50680 | * 11/1998 |
| WO | WO 98/57030 | * 12/1998 |

* cited by examiner

*Primary Examiner*—David Bagnell
*Assistant Examiner*—Jennifer H Gay
(74) *Attorney, Agent, or Firm*—Cantor Colburn LLP

(57) ABSTRACT

Downhole tools and systems can be actuated chemically by placing a chemical sensor downhole and introducing a chemical slug into fluids being pumped downhole. When the slug reaches the sensor a reaction in the sensor may be employed to trigger an event (e.g., actuation) or may cause a count to increase by one on its way to a full count and actuation of a tool or system downhole.

13 Claims, 10 Drawing Sheets

CHEMICAL ACTUATION OF DOWNHOLE TOOLS

CROSS-REFERENCE TO RELATED APPLICATIONS

This application claims the benefit of U.S. Provisional Application Serial No. 60/084,232 filed May 5, 1998, which is incorporated herein by reference.

BACKGROUND OF THE INVENTION

1. Field of the Invention

The invention relates to oil well drilling and production. More particularly, the invention relates to a system for remote actuation of downhole tools employing chemical triggers.

2. Prior Art

For as long as wells have been drilled for any purpose whatsoever, actuating various tools that have been placed downhole has been of concern. The tool can be at tremendous depths and in conditions where communication is quite difficult. Some methods for communication to downhole tools are pressure pulses, short hop communications, acoustic telemetry wireline and permanent electrical conductors. All of these are certainly capable of providing necessary communication to the downhole tools and have been used for years. Because of inherent drawbacks in these methods however, the search for a more reliable and predictable actuation method and system continues. One of the inherent drawbacks is voids in the fluid column. Voids in the fluid column significantly hamper efforts to propagate wave form communication of any kind through the fluid in the wellbore because the "wave" tends to collapse when it hits the interface between liquid and gas. To some extent, of course, the wave will continue but it certainly will be diminished. Thus when the tool to be communicated with is a long distance from the surface or other decision making location, communication there to may require several tries before being successful. One of the more efficient wave form communication techniques is pressure pulsing the well since although the voids in the fluid column are compressible, the pulse at least to some extent will travel through the void and continue in the liquid on the other side thereof. While wave propagation communication techniques are often used in the well industry, a more efficient form is desired.

SUMMARY OF THE INVENTION

The above-discussed and other drawbacks and deficiencies of the prior art are overcome or alleviated by the downhole tool actuation system of the invention.

The invention provides an actuation system for activating a downhole tool, whether that tool be a controller or other type of tool, (e.g. an environment modifying tool) by providing a chemical sensor in the downhole environment at a predetermined location and adapted to detect a certain chemical component. The chemical sensor may be directed to chemicals that are not naturally occurring in or normally introduced to the wellbore or can be adapted to sense chemicals which are indigenous to the system depending upon what use is to be made of the sensor. In the non-naturally or normally occurring embodiment of the invention, the sensor detects chemicals that are introduced to the well for the sole purpose of activating a tool upon sensing the chemical, the sensor generates its own millivolt impulse which is transmitted to a desired location to actuate a tool, provide intelligence downhole or be counted by a counter on its way to a full count and the execution of instructions. This provides for an accurate and non-environmentally effected actuation of downhole tools. The method also avoids stressing components of the system as is the case for prior methods like temporarily pressurizing the tubing, etc.

In the environmental embodiment of the invention, the chemical sensor will be adapted to sense chemical components that are inherent in the well. This may be from breakthrough fluids or may result from other operations, or may even be a part of the desired fluids. Since knowledge in the art allows for predictions of these chemicals, sensors can be used to change the well environment by causing the opening or closing of sleeves, etc. or provide pin point times for when expected occurrences actually do occur. The chemical sensors of the invention may be employed singly, in groups of the same chemical sensors, in groups of different chemical sensors or in groups with sensors for other types of parameters such as pressure, temperature, flow rate etc. In embodiments where groups of different types of sensors are employed for a single actuation, premature actuation is less likely due to the need for more than one occurrence to happen.

The chemical sensor may be operably connected to a controller of any level of "intelligence".

Two other preferred embodiments of the invention employ a similar concept in that a chemical is employed to actuate a downhole tool however the chemical is an active part of the actuator for the tool as opposed to something that is only sensed by a sensor which then provides a signal. Rather, in these embodiments, the chemical is actually used to create an electrical connection that provides for actuation. In one of the embodiments, the chemical is employed to dissolve an encapsulation material so as to create an electrical connection downhole. In the other embodiment, the chemical is an electrolyte which completes a battery downhole and begins the actuation process in that manner. It should be understood however that these embodiments are exemplary in nature and that any type of sensual chemical or chemical property can be employed without departing from the spirit and scope of the invention. Chemicals include radioactive and non-radioactive isotopes and properties include conductivity, resistivity, ion-activity, pH, etc.

In a further aspect of the invention, chemicals are used as a communication tool wherein the tool will confirm that it is properly set by releasing a particular chemical after a setting process. Moreover, the invention contemplates communications, particularly in connection with inflatable tools where the inflatable tool itself is filled with a chemically tagged fluid such that in the event the inflatable tool ruptures or otherwise releases the fluid intended to be maintained therein, such fluid will be easily identifiable at the surface which will signify that a downhole tool has failed. The invention further can identify which downhole tool has failed by using different chemical taggants for each of the inflatable tools employed in a well. Thus, when a particular taggant is identified at the surface, a particular inflatable tool is known to have failed.

Another chemically based actuation tool of the invention is a water-cut sensor which automatically actuates the tool to which it is associated. When the water-cut of the produced fluid reaches a predetermined or selected value the sensor signals the actuator to close and further flow from the area will be halted. One practical application for such chemical actuation is a sliding sleeve which can be shut off when water begins to infiltrate the well. By providing a chemical sensor capable of sensing water at a certain percentage, the tool is much more quickly closed than it would have been had sensing for water been carried out at the surface.

Yet another aspect of the invention provides communication to the surface from a downhole tool which because of an event in its vicinity, has released a chemical into the well production fluid. This embodiment of the invention would preferably use a particular taggant chemical so that when such chemical is identified at the surface it will point directly to the tool at which such event has occurred.

In the final aspect of the invention, chemical communication using tracer gas is also contemplated. One embodiment employing such a tracer gas is wherein a gas lift mandrel is being employed. A tracer chemical is introduced to the lift gas at the surface, or other lift gas introduction location, which tracer chemical is sensual by the gas lift mandrel and will trigger adjustments of the gas lift valves in the gas lift mandrel.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures.

DETAILED DESCRIPTION OF THE PREFERRED EMBODIMENTS

The introduction of chemicals into the well for use with a chemical actuation sensor may be by injection of a volume of chemical having a known density. The precise volume of chemical employed is based in part on expected diffusion over the distance required for transport to the sensor location. In the preferred embodiment however, diffusion is limited during the run downhole by a highly viscous prewash and a highly viscous post wash which sandwich the "pill" in relative stability. By using the washes, the "pill" of the chemical material is prevented from dispersing very far and thus the only amount of chemical necessary is the amount necessary to create any electrical reaction at all. One of ordinary skill in the art is well versed in the amount of chemical material that will be necessary to cause the chemical reaction at the sensor. Additionally, the amount of chemical generally placed in the "pill" is beyond that which is needed so the reaction is relatively assured. Another method for introducing a particular chemical into the well is by employing conventional "ball-dropping" techniques and substituting dissolvable balls or pellets containing the actuator chemical. In this method the dissolution rate of the ball or pellet or an encapsulating material is selected to release the actuator chemical in the vicinity of the sensor proximate enough to cause a reaction therein. As one of skill in the art will recognize, having the ball dissolve on the earlier side for release is preferable to later to avoid the possibility of the ball passing the sensor before release of the chemical.

Another method for delivering the chemical of choice to the wellbore takes into account the temperature of the well at various depths. Once the well temperature profile is determined, a eutectic material having a melting point which is exceeded near and uphole of the depth of the sensor is selected. Once this depth is arrived at the encapsulation material melts and delivers the chemical to the well fluid. The melting points of eutectic materials are easily determined in text books and are therefore well within the skill of one or ordinary skill in the art. The eutectic material selected is then employed to encapsulate the chemical material to be delivered to the wellbore. After encapsulation, the "capsule" can be "ball-dropped" into the well. An additional benefit of the eutectic material method is that many of the eutectic materials are relatively dense and therefore will traverse the distance to the sensor more quickly than some other methods or materials. In another aspect of using eutectic material coated capsules, the eutectic material selected may be one that melts below the sensors discussed herein. In this method, the tools would be actuated as the chemical passes the sensor(s) in the upward moving direction. Tools are thus actuatable from the bottom up. This ability can be beneficial in certain applications .

Figure 1:
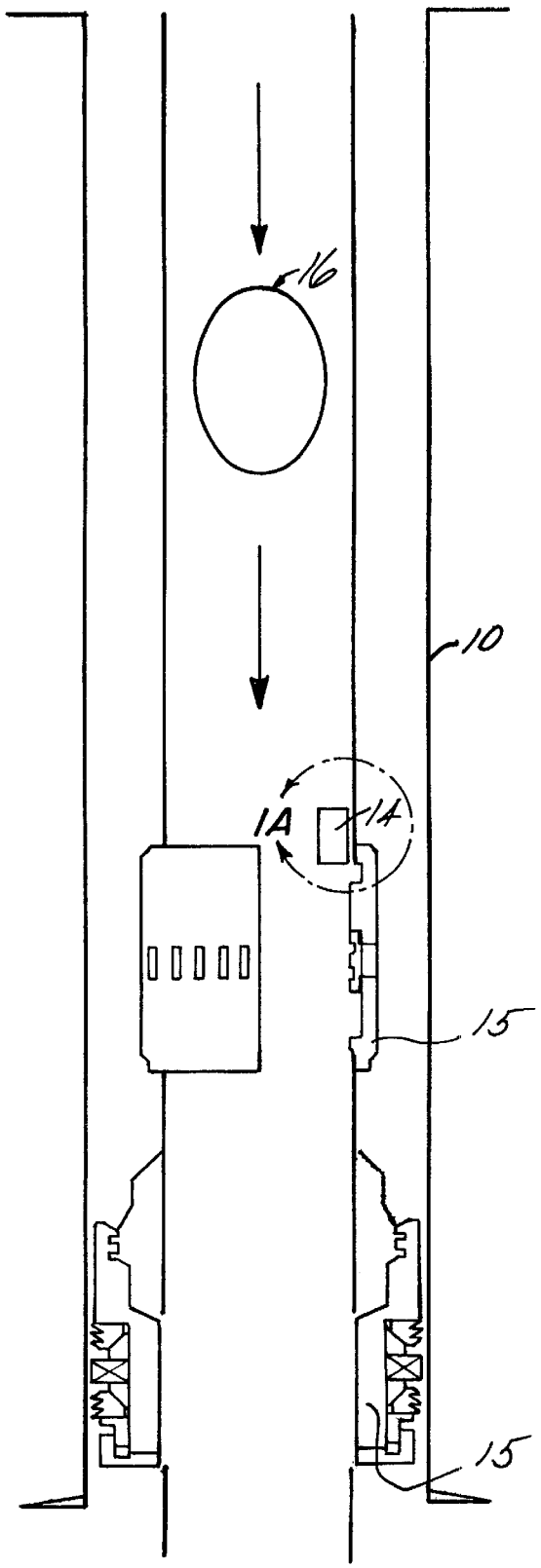
FIG. 1 is a schematic view of a section of a wellbore with a chemical sensor therein and a schematically illustrated chemical "slug"

Referring to FIG. 1, the invention is schematically illustrated. The invention comprises installing one or more chemical sensors 14 in a wellbore 10. The sensor can be adapted to sense any of a number of chemical compositions such as fluorobenzoates, chlorobenzoates, fluoromethylbenzoates, perfluoroaliphatic acids, etc. depending upon other ambient chemistry downhole and whether the sensor is intended to be actuated on queue or whether the sensor is to be actuated upon an occurrence not directly related to an action comprising a specific chemical release for the purpose of actuation. Depending upon the natural chemistry of the wellbore and the types of chemicals being introduced for stimulation, remediation, fracturing, etc. the selection of tracer chemicals will be different.

The sensor 14 is specifically selected to detect a known or predicted concentration of a specific chemical or ion present, or to be introduced, in the wellbore. Providing a plurality of such sensors for the same or different chemicals expands the utility of the invention.

Sensors contemplated will produce a millivolt impulse upon exposure to the appropriate chemical composition. The millivolt impulse is readable by a downhole tool or tools 15 or control system which then will carry out a predetermined action. The predetermined action may be to actuate a tool (or tools), count the pulse until a predetermined number of pulses is received. The receipt of multiple pieces of information may also be directly used for an actuation program.

Figure 1A:
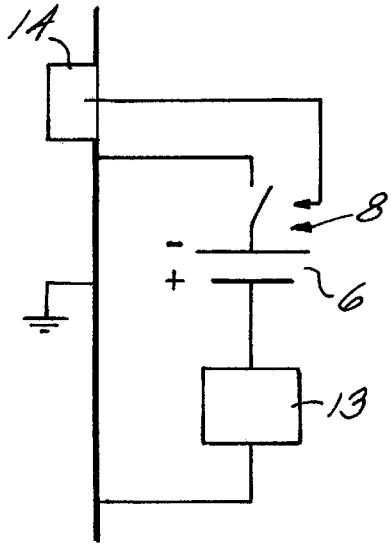
FIG. 1A is an enlarged view of the circumscribed section of FIG. 1 identified by circumscription line 1A—1A.

FIG. 1A shows more detail of a sensor layout. It will be understood that the exact type of sensor impulse structure may be altered while not departing from the scope of the invention. Sensor 14 is communicatively connected to and triggers switch 8 closing a circuit to battery 6 and powering actuation mechanism 13.

One of the primary advantages of employing the method of the invention to actuate tools at a selected time is that pumping a chemical slug 16 into the well communicates the "message" regardless of the integrity of the fluid column. As discussed above, and as one of skill in the art will recognize, if the fluid column is separated by a void, a "pressure pulse" communication method will not be as effective as would be desired because of loss occasioned by the void(s) in the column. The chemical slug will arrive at the sensor and will communicate the "message" to the sensor even if there are a number of voids in the fluid column. The chemical slug is not affected by the void(s). Upon arriving at the sensor, the sensor will register the presence of the chemical and send a millivolt impulse to whatever tool has been operably attached thereto. An action as noted above will be taken and may be the immediate adjustment of one or more downhole tools or the addition of a count to a counter that will cause an action at a predetermined count level. Reliable actuation is thus simply and safely assured.

The actuation device and method of the invention is also employable to automatically adjust tools in the wellbore based upon real time conditions. More specifically, for example, a sensor placed downhole and in operable communication with a sliding sleeve is adapted to sense a part of a chemical composition of a fluid that is undesirable. A particular example of this is to sense chloride ions for water breakthrough. Since the amount of chloride ions in the water which threatens breakthrough at any position in the well can be determined by pre-completion reservoir analysis(drill stem testing/production testing). Knowledge of the concentration allows the selection of an appropriate sensor to sense that concentration. When the sensor emits its signal, a sleeve will immediately close. As one of ordinary skill in the art will appreciate, the more quickly a breakthrough can be halted, the better the yield from the well. Of course, this concept is not limited to water breakthrough. The sensor can be adapted to sense any chemical and so can distinguish between any fluids present downhole and actuate tools accordingly to prevent the influx of undesirable fluid or encourage influx of desirable fluid.

Just as the invention has been described to detect a chemical and actuate a tool, it can be employed in the reverse. More specifically, and still referring to FIG. 1, the sensor may be configured to react to the absence of a chemical and trigger a reaction. This arrangement can be very beneficial in a situation where a particular actuation is indicated at the surface and the signal is sent to so actuate. The sensor here would inhibit actuation until a particular parameter is met. Potentially, this could increase safety of certain operations. The sensor could also react in the presence of one chemical but only in the absence of another. Other iterations are also within the scope of the invention.

Figure 2:
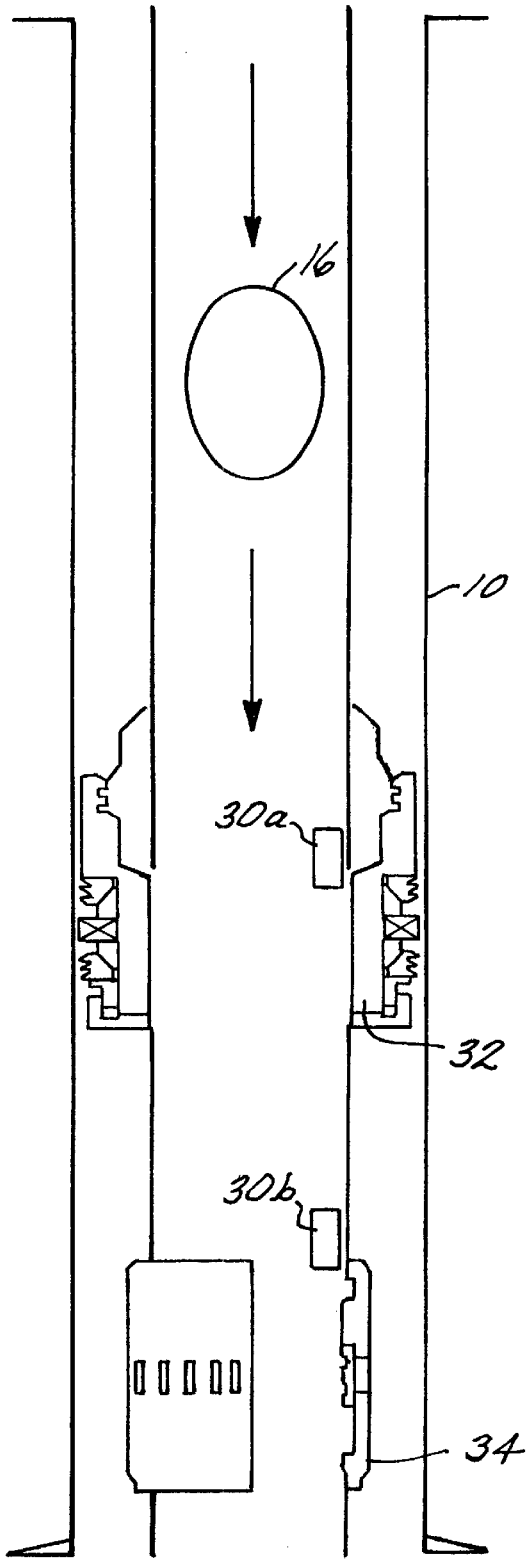
FIG. 2 is a schematic view of a section of wellbore having two same chemical sensors for sequential activation of multiple tools.

In another embodiment of the invention, referring to FIG. 2, chemical sensors are employed as a plurality or multiplicity of sensors 30*a*, 30*b* that sense different or the same chemicals. In the case of different chemicals, different tools can be actuated at well defined times based upon the known period of time required to traverse from injection site to destination sensor. It is also within the scope of the invention to use the same chemical slug to activate a plurality of tools where the sensors are adapted to sense the same chemical and may be in different locations and are connected to different tools. In this embodiment the tools may be actuated in sequence in the downhole or uphole direction depending upon direction of fluid flow and site of injection (flow may depend upon whether the sensor is in the annulus or the bore for example, a packer might be installed uphole of a sliding sleeve). A single slug 16 of a chemical to which sensors 30*a* or 30*b* are receptive, the sensors respectively being on or near each tool would actuate the tool it passed first and then actuate the tool it passes next. In FIG. 2, the packer 32 is activated as slug 16 passes sensor 30*a* and the sleeve 34 is actuated as slug 16 passes sensor 30*b*. Furthermore, this could continue in a seriatim fashion for as long as the slug has enough integrity chemically to be sensed by the sensors (the chemical will disperse as it moves through the tubing. The farther it travels the more dispersed it becomes). Thus, in this way great strings of tools could be actuated seriatim by the single introduction of a chemical slug. Confidence of actuation would be high and many of the possibly damage producing prior art methods are unnecessary.

The chemical slug method is insensitive to other conventional downhole operations or environment such as mechanical manipulation, pressure or temperature. This method is therefore extremely reliable and predictable.

Figure 3:
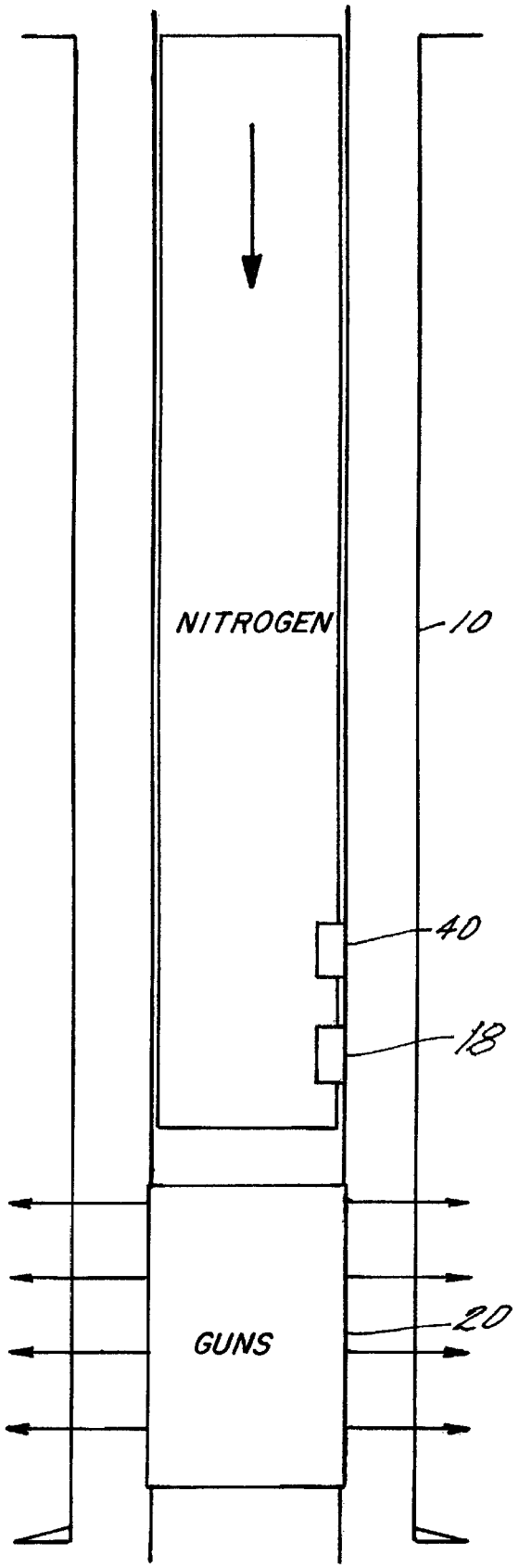
FIG. 3 is a schematic of a section of wellbore having two different types of sensors in series so that redundance must be had prior to actuation of the tool.

Another embodiment of the invention, referring to FIG. 3,enhances the operation of tools such as a perforating gun initiator (e.g. a TCP firing head system available commercially from Baker Oil Tools, Houston, Tex.). Conventionally, the system is actuated by pressuring up on the system. This, however, sometimes leads to premature firing due to pressure buildup in the area of the sensor from sources other than surface introduction of pressure. With the invention, a dual sensor system (FIG. 3) is illustrated which employs both a chemical sensor 40 and a pressure sensor 18. Conventionally, Nitrogen is often employed to pressurize the system to actuate the initiator 20. Unfortunately, and as noted above, prior systems looking only for pressure, sometimes fire before the nitrogen has even been pumped into the borehole. This is due to other well operations causing pressure buildup such as explosions, stuck tools, etc. In the present system however, the risk of early firing is significantly reduced because an over pressure situation alone will not fire the initiator. In the invention a chemical sensor would also be provided in series with the pressure sensor. Thus, unless the nitrogen were present (only being present due to having been pumped in to pressurize the system), the initiator would not fire. The pressure would trip pressure sensor 18 and the gas would trigger chemical sensor 40. Both need to be triggered before the initiator will fire. The necessity of both sensors being tripped may be sequential or simultaneous. This embodiment beneficially distinguishes between liquid induced and gas (Nitrogen) induced pressure.

Figure 4:
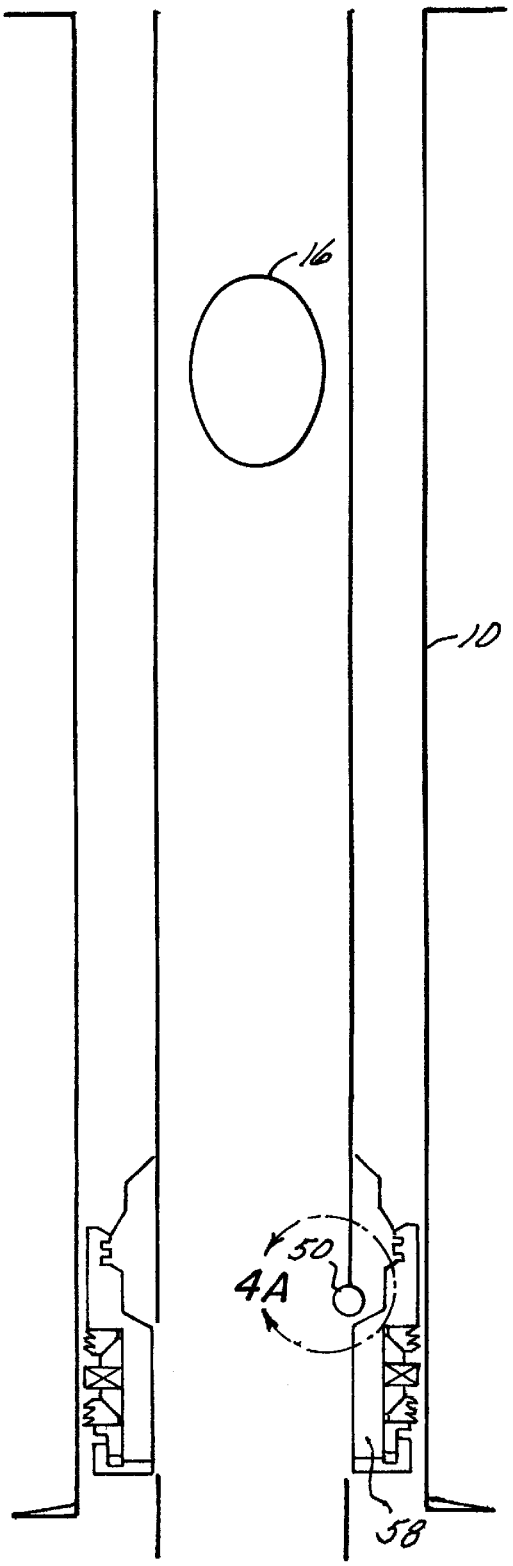
FIG. 4 is a schematic view of an alternate embodiment of the invention with an encapsulated conductive electrode.
Figure 4A:
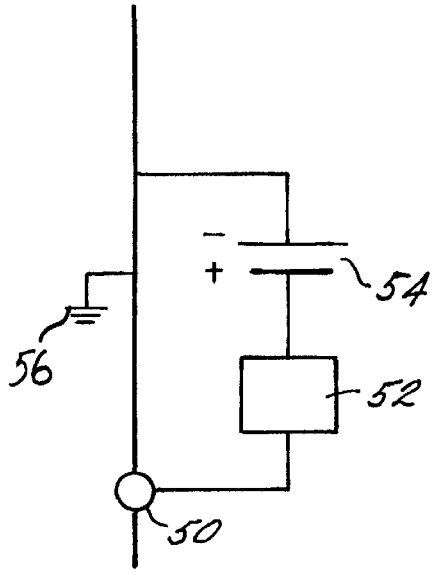
FIG. 4A is an enlarged view of the circumscribed section of FIG. 4 identified by circumscription line 4A—4A.

In another embodiment of the invention, referring to FIGS. 4 and 4A, the "sensor" is not actually a sensor in the common meaning of the term but rather is an encapsulated electrode 50 of an electrical system(see FIG. 4A). The encapsulation material is a substance calculated to be dissolvable by the chemical being injected into the well to trigger the actuator 52. Upon dissolution of the encapsulation material, the electrode is grounded to the casing or to the wellbore fluids and completes the circuit. Battery 54 as is illustrated in FIG. 4A, was initially connected to ground at 56 but the circuit was not complete because since electrode 50 was not grounded due to the encapsulation material. Dissolving the encapsulated material completes the circuit and allows power to flow across the actuator mechanism 52 to actuate the subject tool 58. Some preferred encapsulation materials include but are not limited to acrylic or cellulose coatings. Acrylics are dissolvable in aromatics and chlorinated hydrocarbons. Cellulose is dissolvable in organic solvents and strong acids or bases.

Figure 5:
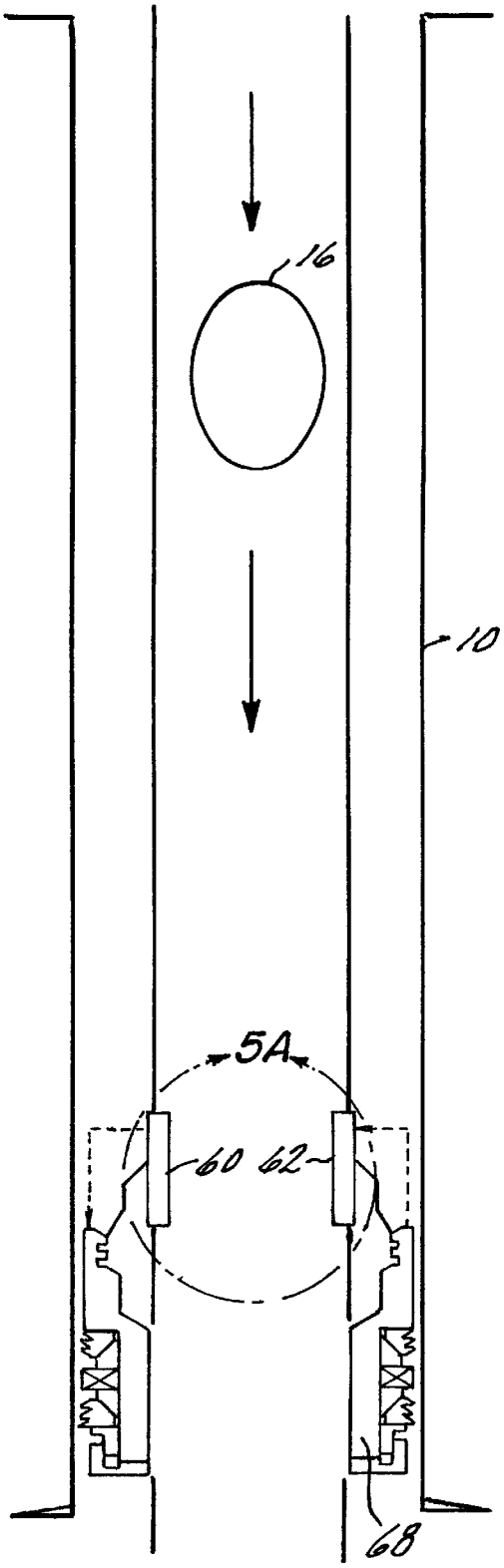
FIG. 5 is a schematic view of another embodiment of the invention where an electrolyte solution is the "pill" and the "sensors" are plates of a battery.
Figure 5A:
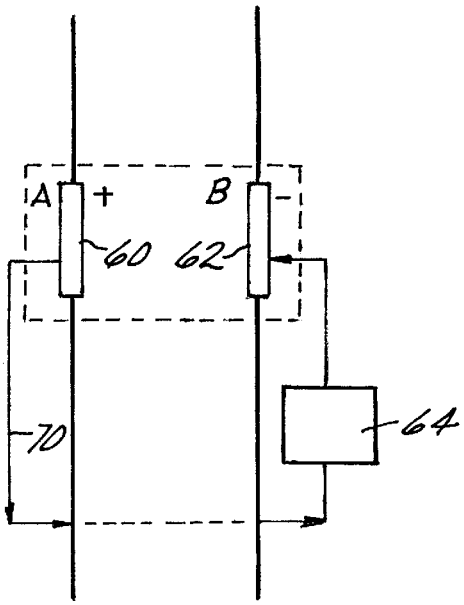
FIG. 5A is an enlarged view of the circumscribed section of FIG. 5 identified by circumscription line 5A—5A.

In yet another embodiment of the invention, referring to FIGS. 5 and 5A, the chemical slug 16 is an electrolytic material. Some preferred materials include but are not limited to Zinc and Copper for use as electrodes and Ion-Sulfates for use as the electrolytic fluid. The electrolyte provides for actuation of a downhole tool by providing the final element necessary to complete a partially built battery downhole. More specifically, the actuator includes two electrodes (cathode and anode) placed in spaced relationship with one another. The materials of the cathode and anode are selected as they would have been for a battery which is known to the art. The plates are illustrated in FIGS. 5 and 5A as 60 and 62. The circuit is otherwise complete as illustrated by arrows 70 which are intended to indicate electrical connectors. The actuation mechanism 64 then is electrically connected at all points necessary for being powered and merely requires the addition of an electrolyte to the battery which spans the tubing. Upon pumping a pill (electrolyte in this embodiment) 16 downhole, the battery is completed when the electrolyte arrives and allows the electrochemical reaction between the cathode and anode 60 and 62 to take place. The electrical energy thus created powers the actuation mechanism to operate the downhole tool 68.

Figure 6:
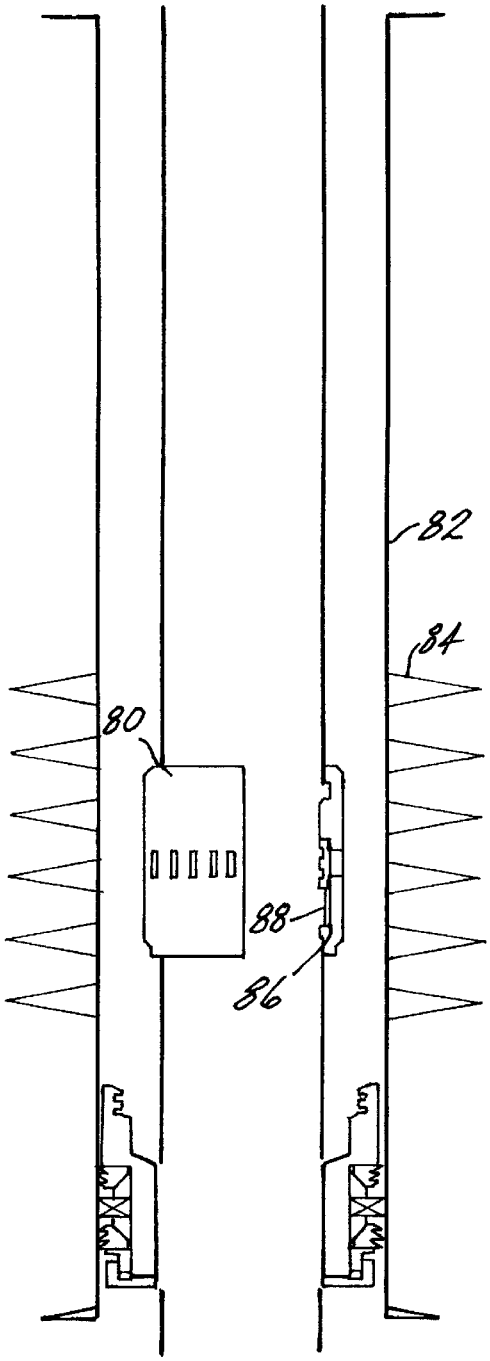
FIG. 6 is a schematic view of another embodiment of the invention wherein a chemical communicator is housed in a reservoir awaiting release upon tool actuation.
Figure 6A:
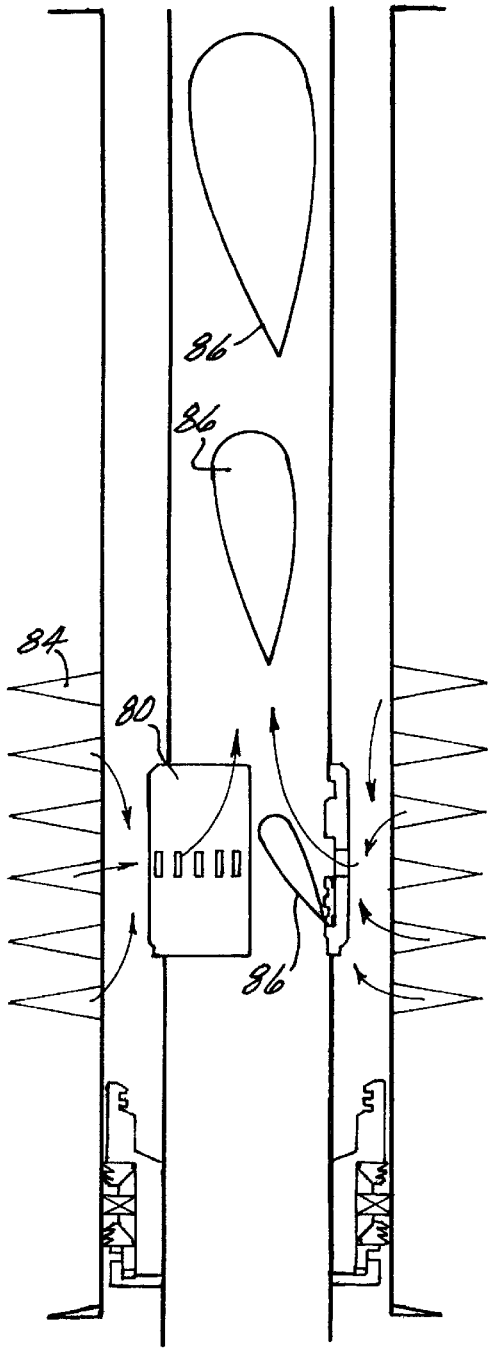
FIG. 6A is the embodiment of FIG. 6 after actuation of the tool and while the chemical is being released from its reservoir.

In another embodiment of the invention, referring to FIGS. 6 and 6A, a downhole tool 80 disposed within wellbore 82 and in the area of perforations 84 includes a chemical 86 maintained in a reservoir 88 in tool 80, the reservoir 88 is openable upon tool actuation. When the tool is actuated, the chemical 86 is released. Release can be by rupture of the reservoir, or by a mechanical opening mechanism or the like. Once released, the chemical travels with production fluids to be detected at the surface. At the surface fluid 86 is detectable to confirm that the tool has indeed actuated.

Figure 7:
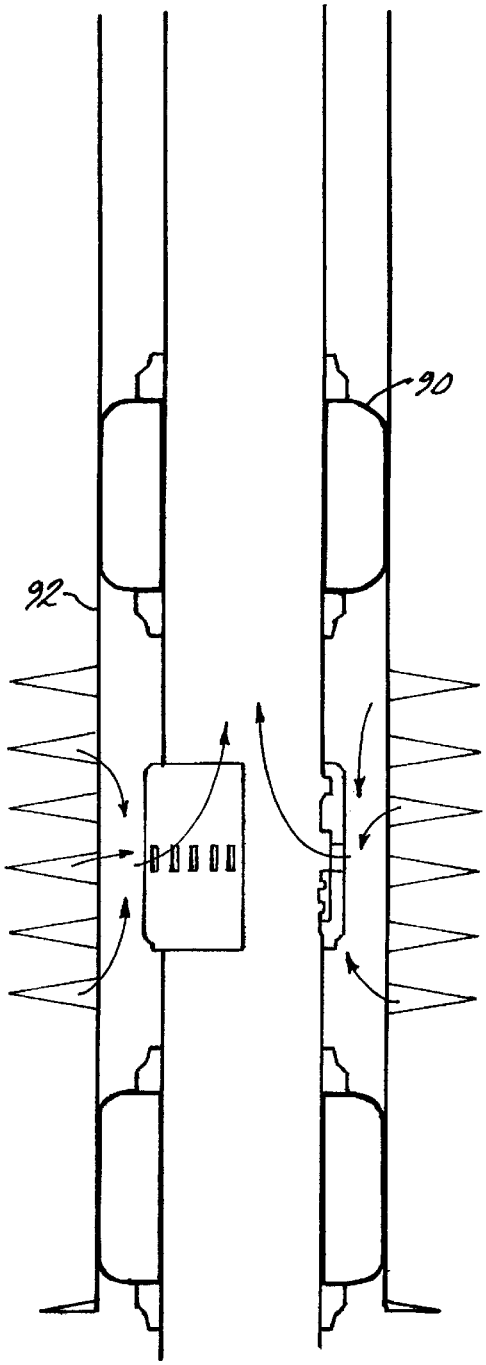
FIG. 7 is another embodiment of the invention wherein inflatable tools have been set, said tools being filled with a chemically tagged inflation fluid.
Figure 7A:
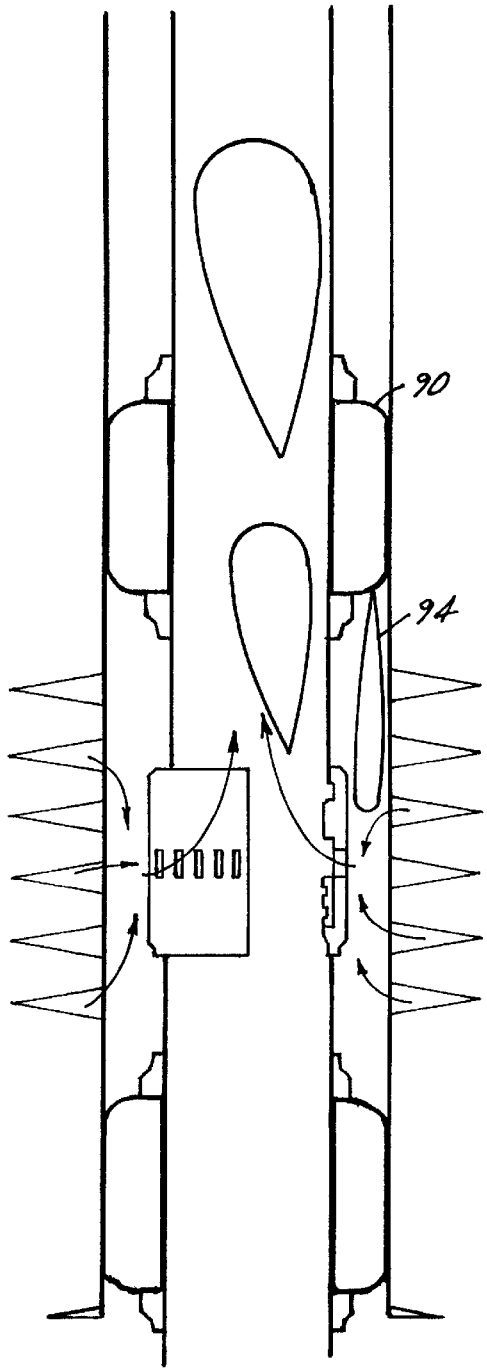
FIG. 7A schematically illustrates the invention of FIG. 7 wherein a tool failure has occurred thus leaking chemically tagged fluids into the production fluid for sensing at the surface.

Referring to FIGS. 7 and 7A, yet another embodiment of the invention is schematically illustrated. The figures are sequential representations and signify the change from a normal condition to a failed condition within the inflatable tools illustrated therein. In drawing FIG. 7, inflatable element 90 is disposed within well bore 92 and in the depiction of FIG. 7 is operating properly and is fully set. In FIG. 7A however, element 90 has ruptured, due to any number of factors, and is leaking inflation fluid. In the prior art it would have been exceedingly difficult to determine that an inflatable element had ruptured and the condition would not likely be discovered either for extended period of time or until other damage had occurred in the well due to the failed inflatable element. In the present invention however, upon rupture of element 90, the inflation fluid 94 which has been previously tagged with a chemical agent will be easily detectable in the production fluid when that fluid reaches the surface. The chemical selected for tagging the inflation fluid will preferably be one that is not easily dispersible within the production well fluid as is the case with conventional hydraulic fluid or well fluids used to inflate inflatable elements. In a preferred embodiment of this invention, a different chemical taggant would be employed for each inflatable element within the well. By so providing and keeping track of the different chemical taggants, simple analysis at the surface will provide immediate indication of which inflatable element has failed thus facilitating the repair or replacement thereof. Significant time savings is realized over prior art methods and the art is significantly benefited.

Figure 8:
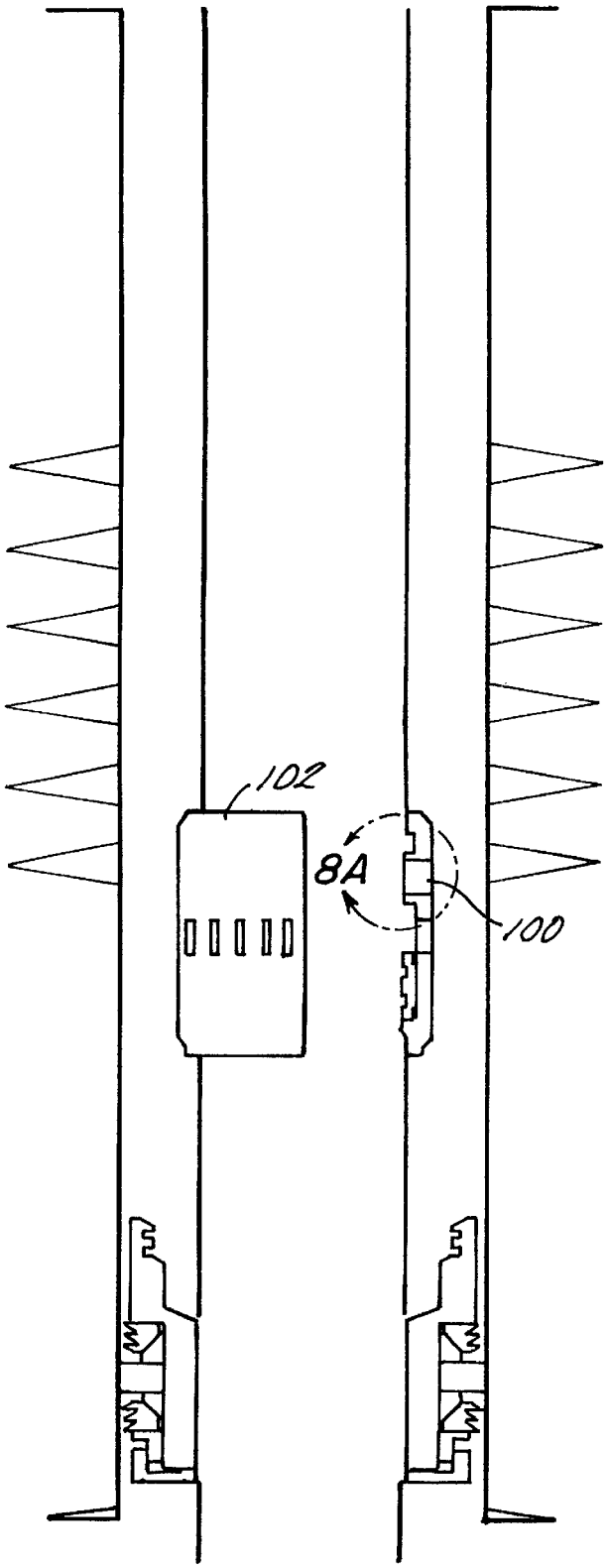
FIG. 8 is a schematic illustration of a chemical based water-cut sensor disposed downhole which when sensing a particular percentage of water in the production fluid will automatically close the downhole tool associated therewith.
Figure 8A:
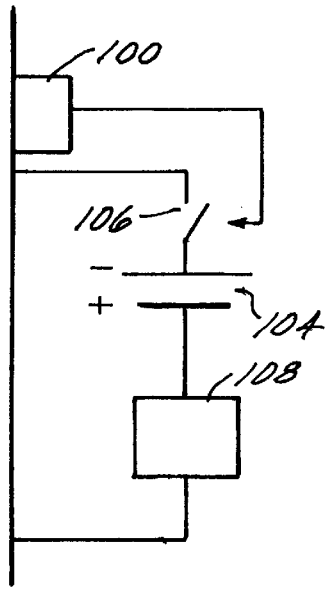
FIG. 8A is an enlarged view of the circumscribed area 8A—8A in FIG. 8.

Referring to FIGS. 8 and 8A yet another embodiment of the present invention is schematically illustrated. In this embodiment of the invention, a chemical water-cut sensor 100 is installed in a sliding sleeve 102 in order to be immediately disposed at the site of the entry of water from the formation. In this embodiment the sliding sleeve 102 would be automatically actuated based upon the perception of a particular percentage of water in the produced fluids. Thus, immediately at the point at which the water-cut of the produced fluids becomes unacceptable or undesirable the sliding sleeve will close. This will avoid the entry of much more significant amounts of water into the production stream, as was the case in prior art methods where the water-cut was not determined until the produced fluids reached the surface. This could mean in the prior art that 20,000 feet of pipe was filled with production fluid having an unacceptable water-cut. Such eventuality is completely avoided by the chemically-based water-cut sensor of this embodiment of the invention. Referring to FIG. 8A, a schematic enlarged view of sensor 100 is provided. The sensor preferably employs a downhole power source such as a battery 104 and a chemical sensor 100 which actuates a switch 106 supplying battery power to an actuation mechanism 108 the actuation mechanism in turn actuates sliding sleeve 102. Oil production is enhanced by the invention and therefore the invention is desirable by the art.

Figure 9:
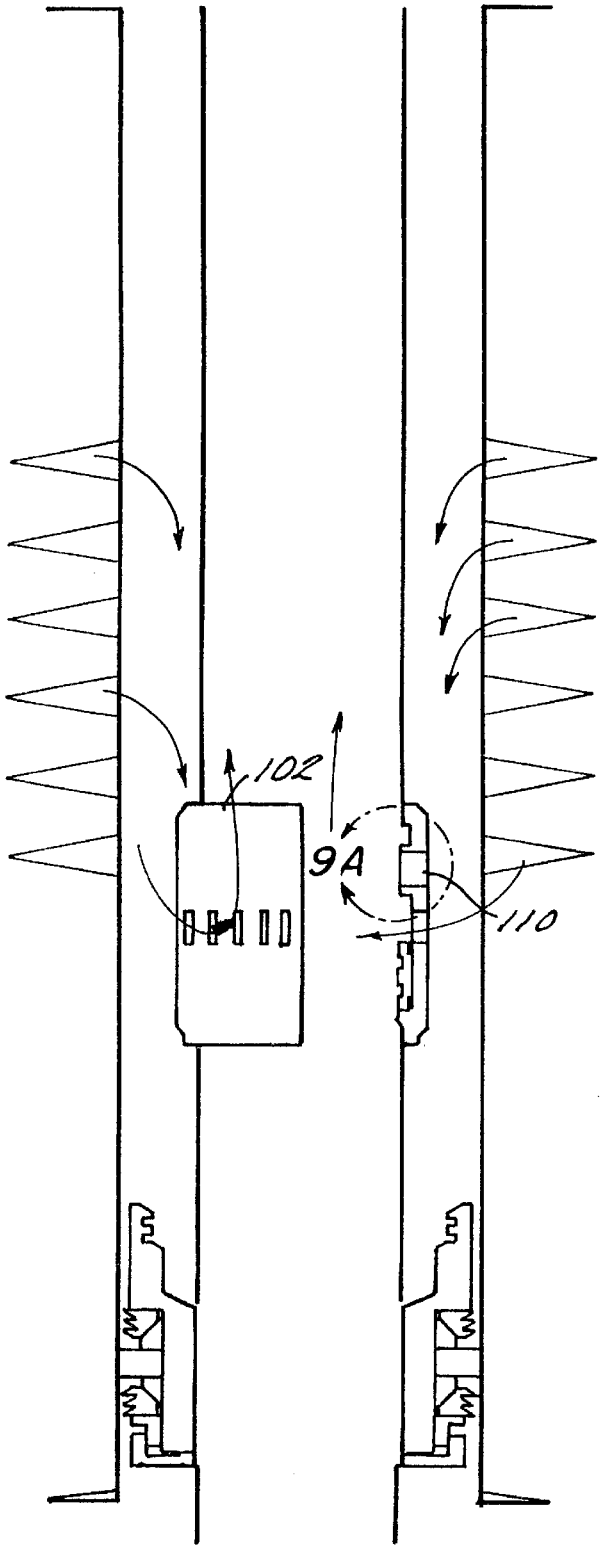
FIG. 9 is a schematic illustration of another embodiment of the invention where communication is effected to the surface by the discharge of a tracer chemical from a downhole tool upon the sensing of a certain occurrence downhole.
Figure 9A:
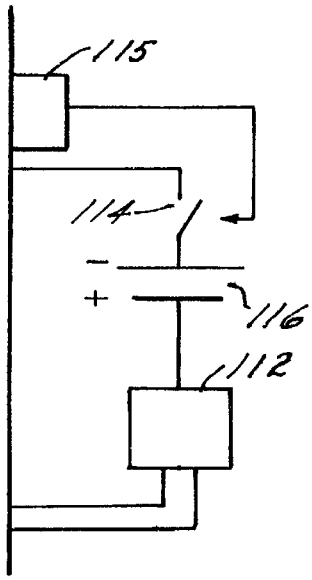
FIG. 9A is an enlarged view of the circumscribed area 9A—9A in FIG. 9.

In another embodiment of the invention, referring to FIGS. 9 and 9A, a chemical species sensor 110 is attached to a tracer discharge assembly 112. Upon the sensing of particular chemical species by the chemical sensor 110, sensor 110 closes switch 114 allowing battery 116 to power the tracer discharge assembly 112. Upon power to the tracer discharge assembly 112 the tracer chemical is released into the production stream and thus after appropriate interval, is detectable at the surface. It is, in a preferred embodiment, highly desirable to index the tracer chemicals with respect to the downhole tools from which they may emanate once so indexed, the particular downhole tool which has experienced an occurrence then will be immediately identified upon detection of the tracer chemical at the surface.

Figure 10:
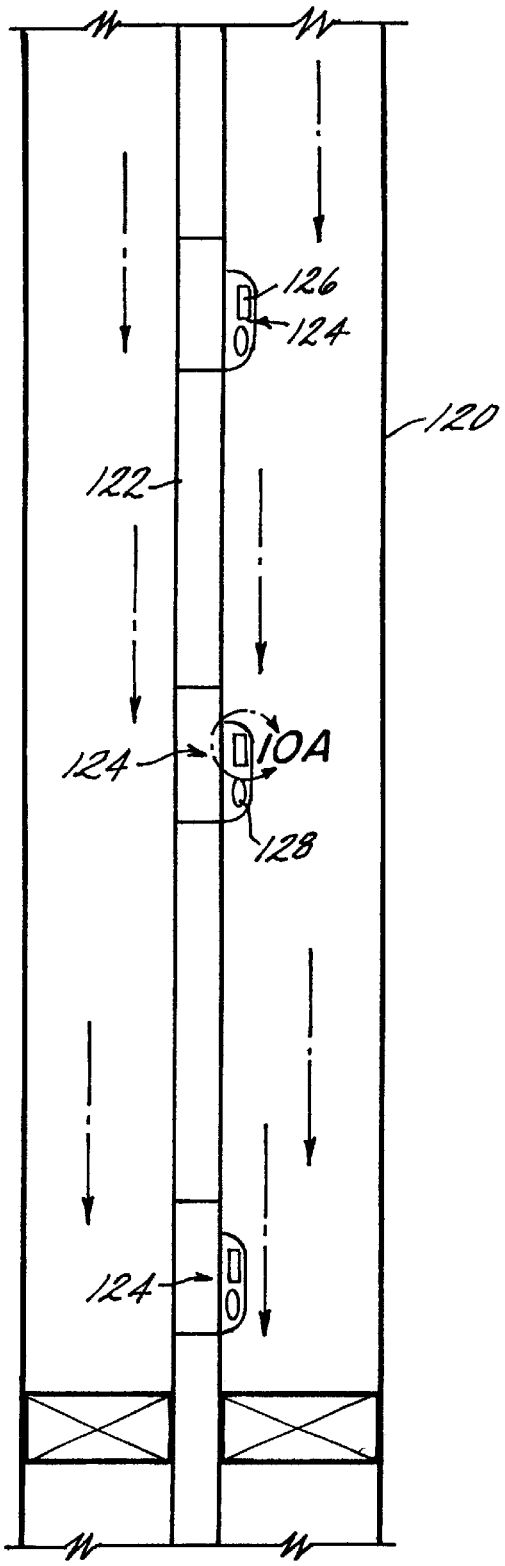
FIG. 10 is a schematic view of another embodiment of the invention employing a tracer in a gas actuated downhole gas lift system.
Figure 10A:
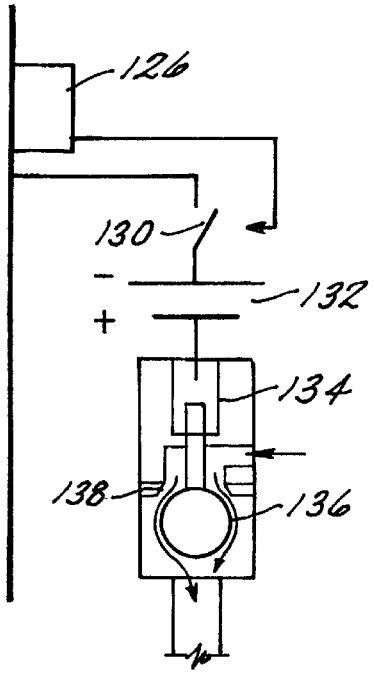
FIG. 10A is enlarged view of the circumscribed area 10A—10A in FIG. 10.

Referring to FIGS. 10 and 10A a schematic illustration of a portion of gas lift well 120 having a gas lift mandrel 122 disposed therein with three injection valve assemblies 124 illustrated thereon is provided. In this embodiment of the invention each of the gas lift assemblies 124 includes, as illustrated in FIG. 10A, a tracer gas sensor 126. The tracer gas sensor 126 is sensitive to a particular tracer chemical (or to certain selected tracer chemicals) introduced into the gas lift gas stream at the surface. Preferably different concentrations of the tracer gas or different tracer gasses will cause the injection valve 128 of injection valve assemblies 124 to open to various different flow rates. The system allows simple control of the flow rates through each of the valves 128 to optimize hydrocarbon production. It should also be noted that it is possible to provide different tracer gas sensors for each of the assemblies 124 thereby allowing individual valves 128 to be controlled independently. In order to further understand the tracer gas sensor and related actuation assembly of the gas lift assembly 124, reference is made to FIG. 10A wherein tracer gas sensor 126 is electrically connected to a switch 130 which when closed allows battery power from battery 132 to flow to the solenoid 134. Movement of solenoid 134 causes the unseating of ball 136 from its ball seat 138 to varying degrees which allows more or less of the lift gas to flow into the production fluid.

The above-discussed and other features and advantages of the present invention will be appreciated and understood by those skilled in the art from the following detailed description and drawings.

What is claimed is:

1. An actuation system for a downhole tool comprising:

at least one chemical sensor placed downhole and responsive to at least one chemical in said wellbore, said at least one chemical sensor providing information regarding presence of said at least one chemical;

a chemical deliverer to deliver a quantity of a chemical to the wellbore said quantity being encapsulated in a material having a melting point which is exceeded by ambient well temperature proximate and uphole of said at least one chemical sensor to release said chemical;

a tool actuator operably connected with said at least one sensor; and a downhole tool operably connected with said actuator.

2. An actuation system for a downhole tool as claimed in claim 1 wherein said downhole tool is a controller which carries out instructions following receipt of information from said at least one chemical sensor.

3. An actuation system for a downhole tool as claimed in claim 2 wherein said instructions are to actuate said downhole tool.

4. An actuation system for a downhole tool as claimed in claim 1 wherein said quantity is in the form of a slug of said chemical.

5. An actuation system for a downhole tool as claimed in claim 1 wherein said quantity is in the form of a defuseable quantity of said chemical.

6. An actuation system for a downhole tool as claimed in claim 1 wherein said quantity is in the form of a cohesive dissolvable aggregate.

7. An actuation system for a downhole tool as claimed in claim 1 wherein said quantity is further coated with a dissolvable material.

8. An actuation system for a downhole tool as claimed in claim 1 wherein said material is eutectic.

9. An actuation system for a downhole tool comprising:

at least one chemical sensor placed downhole and responsive to at least one chemical in said wellbore, said at least one chemical sensor providing information regarding presence of said at least one chemical;

a chemical deliverer to deliver a quantity of a chemical to the wellbore said quantity being encapsulated in an eutectic material having a melting point which is exceeded by ambient well temperature below said at least one chemical sensor to release said chemical and wherein a specific gravity of the chemical is lower than ambient well fluid such that upon release of the chemical, it migrates uphole;

a tool actuator operably connected with said at least one sensor; and a downhole tool operably connected with said actuator.

10. An actuation system for a downhole tool in a wellbore comprising:

at least one chemical sensor placed downhole in response to at least one chemical in said wellbore, said at least one chemical sensor providing information regarding presence of said at least one chemical;

a tool actuator operably connected with said at least one sensor; and a controller operably connected with said actuator, said controller having instructions to count occurrences of receipt of information from said at least one chemical sensor until a selected count number is reached and then to take a selected action.

11. An automatic modification system comprising:

a wellbore;

at least one chemical sensor disposed in said wellbore, said sensor sensing a selected concentration of a particular chemical;

a controller operably connected to said sensor and capable of receiving information from said sensor, said controller counting occurrences of information receipt from said at least one sensor until a specific count is reached and said controller executes instructions.

12. An automatic modification system as claimed in claim 11 wherein said downhole tool is a well modifying tool, said tool being actuated in response to said information received from said at least one sensor.

13. An automatic modification system as claimed in claim 11 wherein said at least one sensor senses a chemical constituent of a downhole fluid threatening breakthrough into said wellbore, said sensor being connected to a choke, said choke being responsive to information received from said sensor.

* * * * *